US005704650A

United States Patent [19]

Laurash et al.

[11] Patent Number: 5,704,650

[45] Date of Patent: Jan. 6, 1998

[54] LAMINATED LABEL FORM WITH REMOVABLE PORTIONS

[75] Inventors: David F. Laurash, Bellbrook, Ohio; Joey V. Huddleston, Winter Springs, Fla.; Patrick A. Konkol, Sharonville, Ohio; Jeffery J. Hartke, Little Rock, Ark.; Hugh B. Skees, Dayton, Ohio

[73] Assignee: The Standard Register Company, Dayton, Ohio

[21] Appl. No.: 699,977

[22] Filed: Aug. 20, 1996

Related U.S. Application Data

[63] Continuation of Ser. No. 376,844, Jan. 23, 1995, Pat. No. 5,547,227, which is a continuation-in-part of Ser. No. 276,262, Jul. 18, 1994, Pat. No. 5,486,021, which is a continuation of Ser. No. 961,377, Oct. 15, 1992, Pat. No. 5,383,686.

[51] Int. Cl.[6] ..... B42D 15/00

[52] U.S. Cl. ..... 283/81; 283/101; 283/79

[58] Field of Search ..... 428/40.1, 41.8, 428/42.2, 42.3, 43; 283/81, 79, 80; 40/299

[56] References Cited

U.S. PATENT DOCUMENTS

| | | | |
|---|---|---|---|
| 3,315,387 | 4/1967 | Heuser . | |
| 3,455,576 | 7/1969 | Hammerling . | |
| 3,508,754 | 4/1970 | Shorin . | |
| 3,524,782 | 8/1970 | Buske . | |
| 3,638,340 | 2/1972 | Gottschalk . | |
| 3,860,796 | 1/1975 | Wallace et al. . | |
| 3,914,483 | 10/1975 | Stipek, Jr. . | |
| 3,987,960 | 10/1976 | Gardiner . | |
| 4,204,706 | 5/1980 | Blum et al. . | |
| 4,231,593 | 11/1980 | Bell, Jr. et al. . | |
| 4,306,367 | 12/1981 | Otto . | |
| 4,379,573 | 4/1983 | Lameli et al. . | |
| 4,479,838 | 10/1984 | Dunsirn et al. . | |
| 4,572,855 | 2/1986 | Kalus et al. . | |
| 4,821,439 | 4/1989 | Wilck . | |
| 4,846,504 | 7/1989 | MacGregor et al. . | |
| 4,927,179 | 5/1990 | Ehret et al. . | |
| 4,983,438 | 1/1991 | Jameson . | |
| 4,995,642 | 2/1991 | Juszak et al. | 283/79 X |
| 5,007,191 | 4/1991 | Klein . | |
| 5,039,652 | 8/1991 | Doll et al. . | |
| 5,042,842 | 8/1991 | Green et al. . | |
| 5,071,167 | 12/1991 | O'Brien . | |
| 5,262,251 | 11/1993 | Will et al . | 283/81 X |
| 5,383,686 | 1/1995 | Laurash . | |
| 5,397,052 | 3/1995 | Walz . | |
| 5,486,021 | 1/1996 | Laurash | 283/81 |
| 5,501,393 | 3/1996 | Walz . | |
| 5,547,227 | 8/1996 | Laurash et al. | 283/81 |

*Primary Examiner*—Willmon Fridie, Jr.

*Attorney, Agent, or Firm*—Killworth, Gottman, Hagan & Schaeff, L.L.P.

[57] ABSTRACT

In accordance with the present invention, a multiple-ply label form is provided which includes a plurality of readily removable elements for use in facilitating business operations, such as package shipment. The removable elements include at least one adhesive backed element securable elsewhere by means of the adhesive, and a single-ply and/or multiple-ply element readily separable from the balance of the label form. The adhesive backed element may have one or more plies. Mailing information or other indicia may be applied on each element as desired. The single-ply and/or multiple-ply element may have an adhesive free backing for filing, mailing or other applications related to the business employing the label form.

3 Claims, 3 Drawing Sheets

LAMINATED LABEL FORM WITH REMOVABLE PORTIONS

RELATED APPLICATION

The present application is a continuation of U.S. patent application Ser. No. 08/376,844 filed Jan. 23, 1995, now U.S. Pat. No. 5,547,227, which is a continuation-in-part of U.S. patent application Ser. No. 08/276,262 filed Jul. 18, 1994, now U.S. Pat. No. 5,486,021 issued Jan. 23, 1996, which is a continuation of U.S. patent application Ser. No. 07/961,377 filed Oct. 15, 1992, now U.S. Pat. No. 5,383,686 issued Jan. 24, 1995.

FIELD OF THE INVENTION

The present invention relates generally to labels made from two or more plies which are adhered to one another, more particularly, to multiple-ply label forms which may include at least two removable portions in the form of an adhesive coated label and/or tab and a single-ply and/or multiple-ply card. While the multiple-ply forms of the present invention can be utilized in a number of different business operations including materials handling, inventory control and the like, they are particularly applicable for facilitating package shipping operations, such as certified or registered mail.

BACKGROUND OF THE INVENTION

Package shipping operations have become more and more automated as computers and computer controlled printers have been integrated into systems for monitoring and controlling package handling. Computers maintain a continually updated record of the progress of packages in a delivery channel extending from the shipper to the addressee by receiving data regarding each package at a number of stations along the channel. To facilitate data entry along the package delivery channel, multiple function labels have been developed for replacement of earlier used pocket labels. Multiple function labels reduce the time and effort required to perform data entry and tracking operations to thereby decrease the possibility of mistakes due to human error or negligence.

However, there is a need for an improved multiple-function label form for use in business operations such as materials handling, inventory control, package shipping, prescribing medications and other medical treatments, and the like which is inexpensive to manufacture, convenient and simple to use, and versatile for use in a number of different business environments and applications.

Such an improved multiple-function label form is particularly needed for sending parcels or packages by certified or registered mail. In such an operation, the sender is provided with a postcard for proof of delivery. Upon delivery, the recipient signs the postcard which is then mailed back to the sender. Thus, a multiple function label form is needed which provides an easily attached and removable postcard.

SUMMARY OF THE INVENTION

These needs are met by the multiple-ply label form of the present invention which includes a plurality of readily removable elements for use in facilitating business operations, such as package shipment. The removable elements include at least one adhesive backed label or tab securable elsewhere by means of the adhesive, and a single-ply and/or multiple-ply coupon or card readily separable from the balance of the label form. The adhesive backed label or tab may comprise one or more plies. The single-ply and/or multiple-ply coupon or card may have an adhesive free backing for filing, mailing or other applications related to the business employing the label form.

In accordance with one aspect of the present invention, a multiple-ply label form is provided for use in an operation control system. The form comprises a first ply having an underside and includes at least one first portion and at least one second or reapply portion. The underside of each second portion is substantially coated with an adhesive, such as a pressure sensitive or other re-apply type adhesive. Each portion is readily separable from the first ply. Mailing information or other indicia may be applied on the upper side of each portion as desired. This label form also includes a second ply with an upper side adhesively bonded to the underside of the first ply. Preferably, the upper side of the second ply has a peripheral boundary substantially bonded adhesively to the underside of the first ply.

The second ply includes at least one first section and at least one second or release section respectively in register with the first and second portions of the first ply. The underside of each first portion is permanently bonded with the upper side of its corresponding first section by an adhesive. Each bonded first portion and section form a multiple-ply laminate. Each first portion and first section are readily separable respectively from the first ply and second ply, thus enabling the multiple-ply laminate to be readily separable from the label form. Each second portion is bonded to the upper side of its corresponding second section, yet is readily releasable therefrom. Each second portion of the first ply can be made readily releasable by coating the upper side of its corresponding second section with a release material. Once removed from its second section, each second portion is securable elsewhere by means of the adhesive.

Preferably, each second portion is registered within the periphery of its corresponding second section to help ensure that the second portion will be readily releasable from the second ply. Each second portion could be used as an adhesive backed label or tab and each multiple-ply laminate could be used as a multiple-ply card for return mailing, identification or other applications related to the business employing the label form. When desired, each portion and section may be made readily separable from their respective first ply and second ply by the use of lines of weakness created for example by creasing or perforating the applicable ply around the perimeter of the portion and section.

In one embodiment of this aspect of the present label form, the first ply includes at least one third portion and the second ply includes at least one third section in register with each other. The underside of each third portion is substantially free of an adhesive. Therefore, each third portion could be used as a single-ply card or coupon for filing or other applications related to the business employing the label form. If a card with increased stiffness and durability is needed, adhesive may be applied to one of the third portion and the third section to form a permanent multiple-ply lamination. Alternatively, an imaging system may be associated with the third portion and the third section so that indicia printed on the upper side of each third portion will be duplicated on the upper side of its corresponding third section. In this way, a record of the indicia on the third portion will be maintained on the third section even after removal and disposition of the third portion. The imaging system used may be any one of a number of conventional systems using imaging chemicals or compositions, or it may be any other image reproducing system. For example, one or the other or both of the underside of each third portion and the upper side of its corresponding third section could be provided with a suitable chemical image coating, such as that disclosed in U.S. Pat. Nos. 5,039,652 and 5,284,689. Preferably, each third portion is registered within the periphery of its corresponding third section not only to ensure that each third portion will be readily separable from the first ply but also to ensure full duplication of any image printed on the third portion onto its corresponding third section.

In another embodiment, the second ply has its underside coated with a pressure sensitive adhesive. A release liner is provided which is adapted to substantially cover and releasably bond to the adhesive on the underside of the second ply. Upon removal of the release liner, the underside of the second ply is securable elsewhere by means of the adhesive. The need for a release liner could be eliminated by substantially coating the underside of the second ply with a remoistenable adhesive. If the underside of each first section is coated with the adhesive, the multiple-ply laminate could be a multiple-ply label or tab.

In a further embodiment, the first and second plies respectively have one first portion and first section and two second portions and second sections. One second portion is disposed on each side of the first portion, with each second portion being readily separable from the first portion. The first portion is permanently bonded to the first section to thereby form a multiple-ply card. The multiple-ply card could be used in a number of applications, including as a return postcard which is attached to the package and returned to the sender, providing proof of delivery. The two second portions and the multiple-ply card are readily separable together in one piece from the balance of the label form. Thus, this label form may be used for mailing a parcel by separating the multiple-ply card and the two second portions from the balance of the label form. The card is then adhered to the parcel by contacting the adhesive on the underside of the two second portions with the parcel. After being mailed, the recipient of the parcel can separate the card from the two adhered second portions and return the card to the sender. The first ply and second ply may further include two additional second portions and sections, with each additional second portion being used as a label.

In yet another embodiment, the first ply and second ply respectively include one first portion and section, one second portion and section, and two third portions and sections. The underside of each third portion is substantially free of an adhesive. An imaging system is associated with each third portion and its corresponding third section.

In accordance with another aspect of the present invention, a multiple-ply label form is provided for use in an operation control system. The form comprises one first ply and one second ply with the peripheral boundary of its upper side being substantially bonded adhesively to the underside of the first ply. The first ply includes a plurality of portions. The underside of one reapply portion is substantially coated with an adhesive, while the underside of another portion is substantially free of an adhesive. Each portion is readily separable from the first ply and adapted for having indicia applied thereon. The second ply has one release section and another section respectively in register with the one reapply portion and the other portion. The adhesive on the underside of each one portion bonds to the upper side of its corresponding one release section, yet is readily releasable therefrom. Once removed, each one reapply portion is securable elsewhere by means of the adhesive. In one embodiment, the upper side of the second ply is substantially coated with a release material, except for each other section. Preferably, an imaging system is associated with each other portion and its corresponding other section.

With any of the above embodiments, each release section could be made readily separable from the second ply, and the underside of each second ply could be coated with an adhesive so that the underside of each release section is adhesively coated. This structure would enable each reapply portion to be adhered, removed and then re-adhered to the same or different surfaces.

It is thus an object of the present invention to provide an improved multiple-ply label form having a plurality of readily removable sections for use in business operations such as package shipping which is inexpensive to manufacture. These readily removable sections may be used to perform a variety of functions to facilitate business operations. For example, these readily removable sections may include one or more cards, labels and/or tabs. Such cards, labels and tabs may be of single-ply or multiple-ply construction, with or without an adhesive backing. The present multiple-ply label forms are compatible with most automated printers, such as laser, ink jet, thermal transfer, direct thermal, impact, etc. The readily removable sections are also suitable for tracking and control functions.

These and other objects and advantages of the present invention will become apparent from the following description, and the appended drawings and claims.

DETAILED DESCRIPTION OF THE INVENTION

Although the present invention is herein described in terms of specific embodiments, it will be readily apparent to those skilled in this art that various modifications, rearrangements, and substitutions can be made without departing from the spirit of the invention. The scope of the present invention is thus only limited by the claims appended hereto.

The multiple-ply label forms of the present invention can be utilized in a number of different business operations including materials handling, inventory control and the like. However, such a label form is particularly applicable for facilitating the shipping of packages and other parcels, for example, by certified and registered mail. Accordingly, three of present multiple-ply label forms disclosed in detail herein will be described with reference to such applications. The fourth multiple-ply label form disclosed in detail herein will be described with reference to being used as a prescription form. It should be appreciated that this latter label form is not intended to be so limited.

Figure 3:
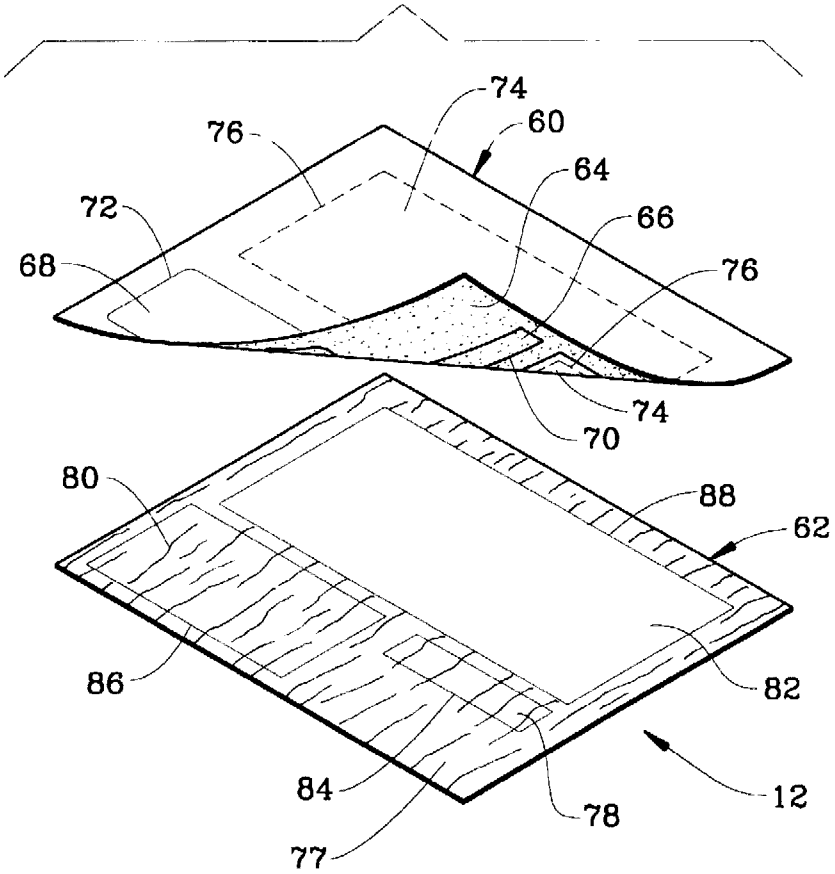
FIG. 3 is an exploded isometric view of an alternative embodiment of the present multiple-ply label form.
Figure 2:
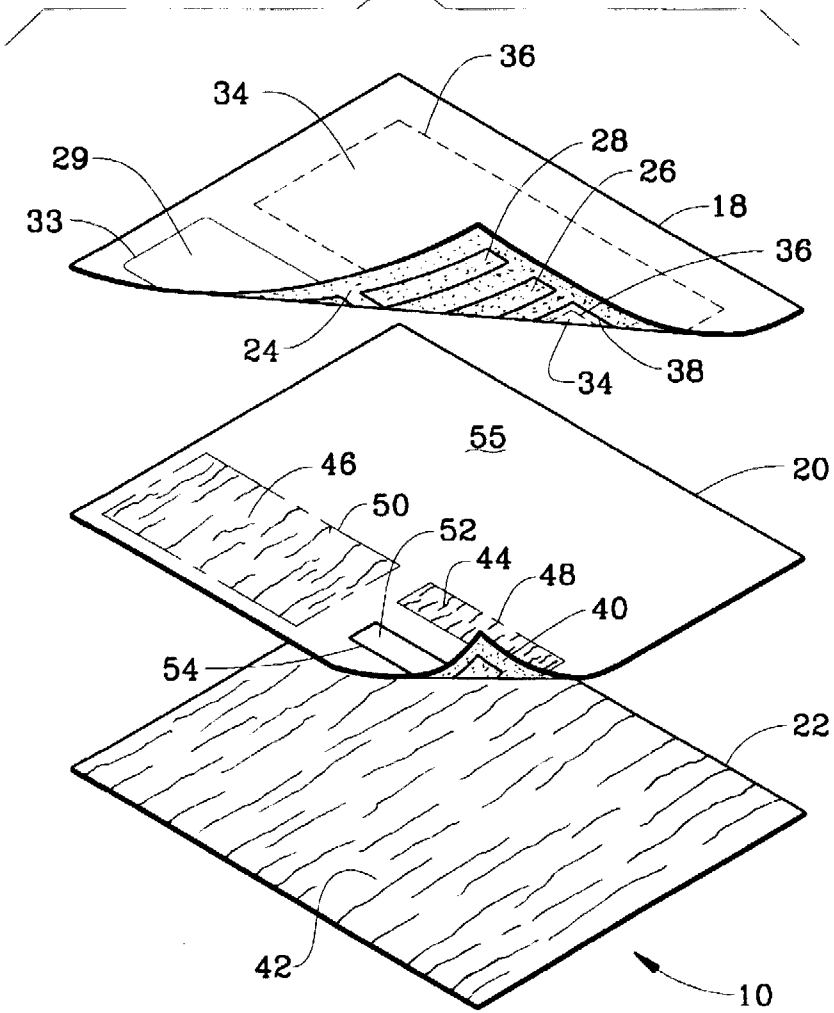
FIG. 2 is an exploded isometric view of the label form of FIG. 1.
Figure 4:
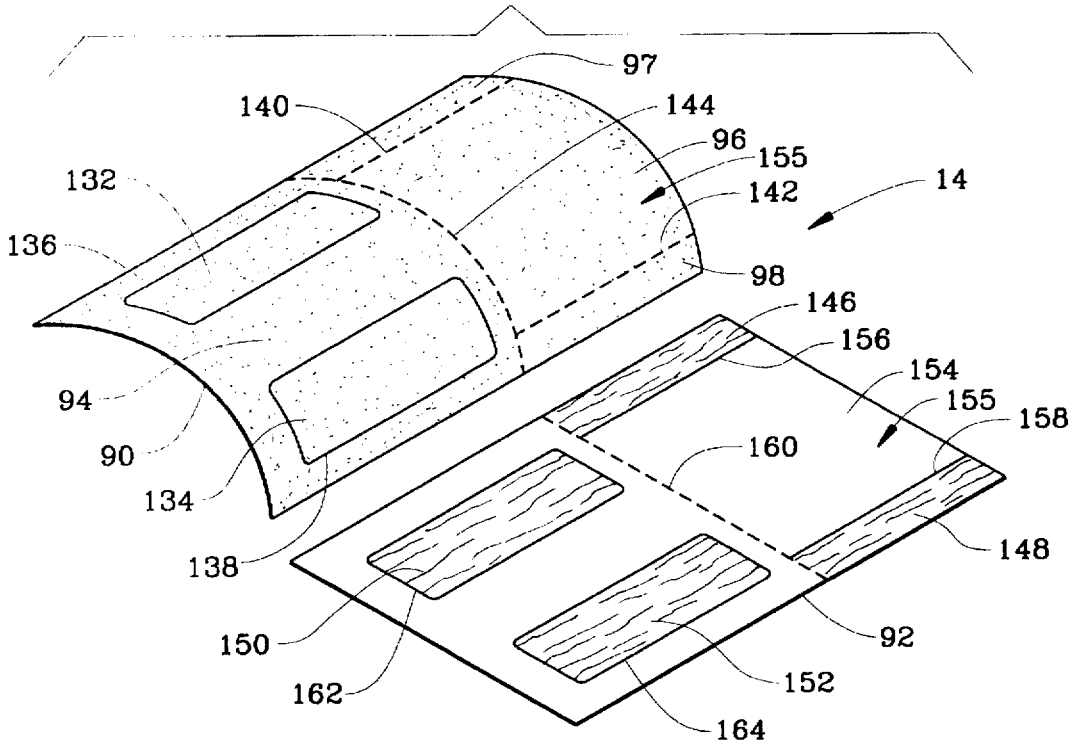
FIG. 4 is an exploded isometric view of another embodiment of the present multiple-ply label form.

Multiple-ply label forms 10, 12 and 14, constructed in accordance with the present invention and shown, respectively, with plies separated in FIGS. 2, 3 and 4, may be used to assist in the automated control, tracking, and recording of package shipping operations. Multiple-ply label form 16, constructed in accordance with the present invention and shown with plies separated in FIG. 5, may be used to assist in the prescribing of medications and other medical treatments, as well as other business operations. The present label forms are designed to be inexpensively produced and to perform essential functions of such automated systems. Accordingly, the present label forms reduce the time and effort of manual operations to reduce the possibilities for human error and negligence and thereby provide improved efficiency and accuracy.

A desirable feature of the present label forms is that they include portions which can be removed from the remainder of the label forms. The portions which are removed can include an adhesive backing to perform as self-sticking labels or tabs, for example, to be adhered to packages, documents related to package shipment, medical forms or some other appropriate surface. The adhesive may be any suitable release adhesive, such as that disclosed in U.S. Pat. No. 5,284,689, which is incorporated herein by reference in its entirety. Most commonly, the adhesive is a pressure sensitive adhesive with a sheet of readily removable release material covering the adhesive until the appropriate time for removal and application to a package or document. Alternately, the adhesive may be a remoistenable adhesive which is activated by the application of moisture. The removed portions can also be free of adhesive such that they can be used for filing, used as postcards for mailing acknowledgements, used for patient identification and other like purposes. The removed portions normally carry information in human readable format, machine readable format, or both human and machine readable formats for identification or informational purposes.

Figure 1:
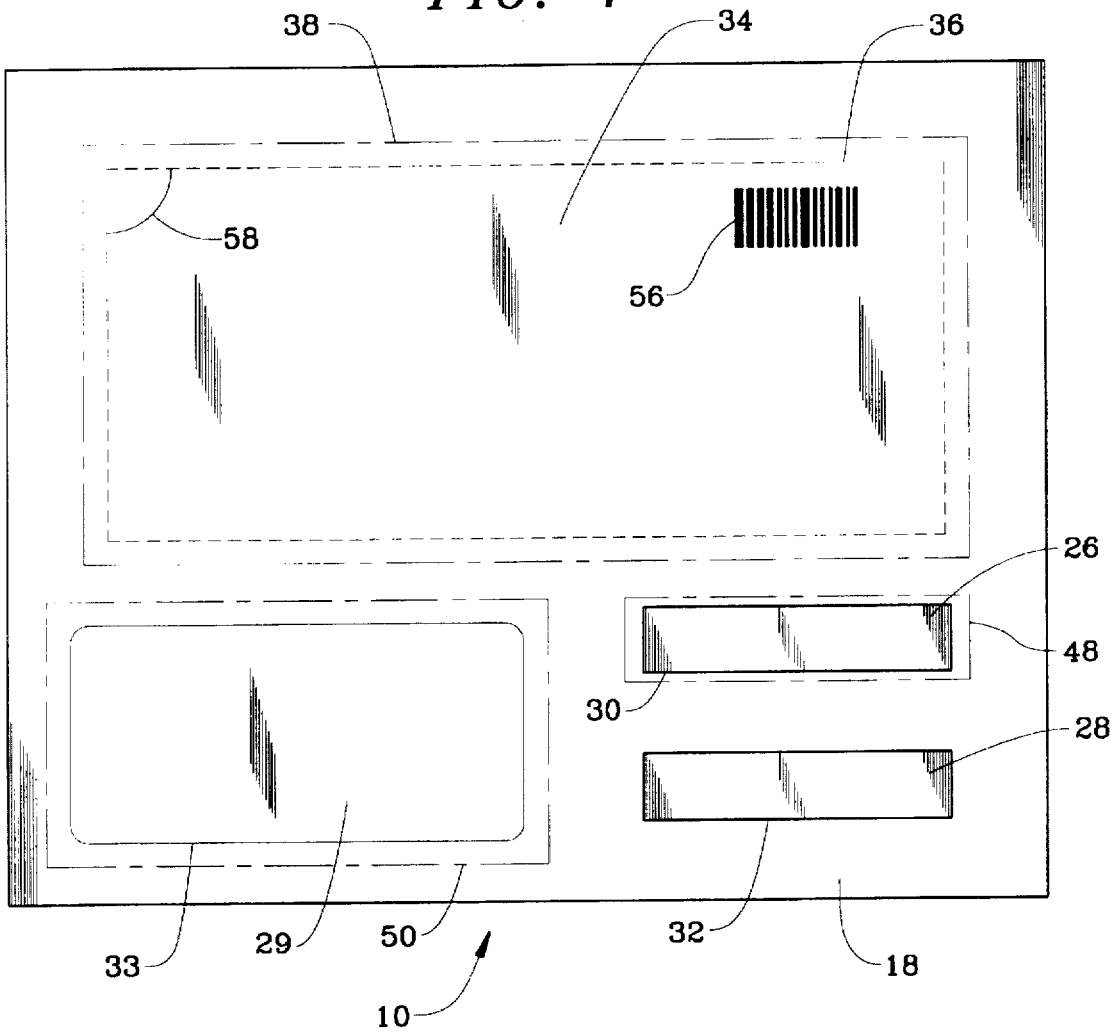
FIG. 1 is a top plan view of one embodiment of the present multiple-ply label form.

Reference is now made to FIGS. 1 and 2 of the drawings which illustrate a three-ply embodiment of the present invention. The label form 10 of FIGS. 1 and 2 is a three-ply laminate comprising a top ply 18, a bottom ply 20 and a release liner ply 22. The top ply 18 has its underside coated with an adhesive 24, preferably a pressure sensitive adhesive, in a pattern which includes the perimeter or outer periphery of the four sides of the generally rectangular top ply 18. Alternatively, the adhesive may be present along only two sides, preferably opposite sides, leaving the other two sides unadhered. The adhesive 24 is also coated onto the underside of tab portions 26 and 28, and label portion 29 of the top ply 18 which are respectively defined by generally rectangular die cuts 30 and 32, and 33 to be readily separable from the remainder of the top ply 18. Each of the tab portions 26 and 28 and the label portion 29 of the top ply 18 could also be defined by a series of perforations or other line of weakness such that it is readily separable from the remainder of the top ply 18. It should be appreciated that in some applications it may be preferred that adhesive 24 on the underside of tab portions 26 and 28, and label portion 29 cover less than the entire area defined by generally rectangular die cuts 30 and 32, and 33. As will be discussed in greater detail below, it is preferable for adhesive 24 on the underside of tab portion 28 to cover the entire area defined by die cut 32.

A card or coupon portion 34 is also defined within the top ply 18 by a line of perforations 36 such that the card portion 34 is readily separable from the top ply 18. Preferably, the coating of adhesive 24 substantially covers the underside of top ply 18 except for the area under the card portion 34 and slightly beyond. That is, the card portion 34, as defined by the line of perforations 36, lies entirely inside the inner periphery of the adhesive 24 as defined by border 38 (hidden in FIG. 1). In this way, when the card portion 34 is separated from the top ply 18, it is assured of being completely free of adhesive. Accordingly, the card portion 34 may be used as a postcard, file entry, acknowledgement or for similar applications relative to the business operations being assisted by use of the label form 10.

It will be appreciated that if the top ply is adhered to the bottom ply only along two sides of the plies, it may be possible to only provide perforations along and adjacent those two margins. It will also be appreciated that the card portion 34 can be a two-ply laminate by applying the adhesive 24 to substantially cover all of the underside of top ply 18, including the area under the card portion 34. The card portion 34 is then allowed to permanently bond with the bottom ply 20. For ease of removal, the perforations 36 would be formed through both plies 18 and 20.

The bottom ply 20 has a coating of adhesive 40 on its underside. The coating of adhesive 40 may cover substantially the entire underside of the bottom ply 20. Alternatively, the adhesive 40 can also be coated in any other pattern sufficient to secure the label form 10 to a package being shipped. If adhesive 40 is a pressure sensitive adhesive, then a release liner ply 22 is releasably adhered to the bottom ply 20 by means of the pressure sensitive adhesive 40 to permit easy handling of the label form 10 until the label form 10 is to be adhesively secured to a package. The release liner ply 22 is coated on its upper side 42 with a silicone polymer or other suitable release material to permit easy release of the release liner ply 22 from the pressure sensitive adhesive 40. If adhesive 40 is a water-activated adhesive, release liner ply 22 would not be needed.

The bottom ply 20 has a tab release section 44 and a label release section 46, each of which are also coated with a silicone polymer for release of the adhesive 24 on the underside of the tab portion 26 and the label portion 29, respectively. The tab release section 44 and label release section 46 are accordingly located in register with the tab portion 26 and the label portion 29 on the underside of the top ply 18. The tab release section 44 and label release section 46 are preferably slightly larger than the tab portion 26 and label portion 29. The tab and label release sections 44 and 46 each have a respective outer periphery 48 and 50 which circumscribe the die cuts 30 and 33.

The bottom ply 20 also has a tab section 52 which is defined by generally rectangular die cut 54 and a card section 55 which is defined as the general area of the bottom ply 20 lying underneath card portion 34. The tab section 52 and the card section 55 are respectively located in register with the underside of tab portion 28 and card portion 34 of top ply 18. Tab section 52, in the illustrated embodiment, is free of any release material and suitable for permanently bonding to tab portion 28 via the adhesive 24 on the underside of the tab portion 28 to thereby form a two-ply tab readily separable from the label form 10. The tab section 52 is preferably the same size as the tab portion 28, thus enabling both the die cuts 32 and 54 to be formed by a single cut extending through both plies 18 and 20. Alternatively, tab section 52 may be slightly larger than tab portion 28. Card section 55 is also free of any release material and suitable for permanently bonding to the underside of top ply 18 via adhesive 24 thereon, outside of the inner periphery defined by border 38. It will be appreciated that while the above die cuts 30, 32, 33, 36 and 52, as well as those discussed below, are illustrated as being generally rectangular, other shapes may be utilized, if desired. It will also be appreciated that tab portion 28 and section 52 could respectively be in the same form as tab portion 26 and release section 44 in the present application and as shown in U.S. patent application Ser. No. 08/276,262 entitled LABEL FOR OPERATION CONTROL SYSTEM, which is a continuation of U.S. patent application Ser. No. 07/961,377, each of which is incorporated herein by reference in their entirety.

For use in package shipping operations, package identification indicia 56 is printed on the label form 10. As illustrated, the identification indicia 56 is printed as a machine readable bar code and is shown on the card portion 34. The identification indicia 56, in either machine readable form, human readable form or both, may also be printed onto the top ply 18 in an area exterior to the card portion 34. Such indicia may also be printed onto the top ply 18 in the tab portions 26 and 28 or the label portion 29. For the label form 10 of FIGS. 1 and 2, the identification indicia 56 on the upper side of card portion 34 can also be transferred to the upper side of card section 55 on bottom ply 20 by some form of an imaging system (not shown). The interface between card portion 34 and card section 55 may be provided with carbonless imaging chemicals such that when an impact or pressure image is applied to the upper side of the top ply 18, a duplicate image is produced on the upper side of the bottom ply 20 in the card section 55. For example, the underside of the card portion 34 could be coated or impregnated with carbonless copy components including an encapsulated color former composition, and the upper side of the corresponding card section 55 could be coated or impregnated with a color developer composition, in accordance with the teachings of U.S. Pat. Nos. 5,039,652 and 5,284,689, which are each incorporated herein by reference.

Alternatively, the upper side of the card section 55 could be coated with a chemical self-contained material, in which case,no coating is required on the underside of the card portion 34. A self-contained coating is one where both chemical reactants required for image formation are contained in the same coating. It is also contemplated that the adhesive 24 on the underside of any adhesive backed top ply portion could contain carbonless copy components including a microencapsulated color former composition, and that the upper side of the corresponding bottom ply section could be coated or impregnated with a color developer composition, in order for an image made on an adhesive backed top ply portion to appear on the corresponding bottom ply section. In addition, the corresponding bottom ply section could include a self-contained chemical imaging material. It is preferred that any imaging coating used be applied locally only where a duplicate image is needed. However, either or both the top ply 18 and bottom ply 20 may be fully coated.

As should be apparent, the release liner ply 22 is peeled away from the bottom ply 20 and the remaining two-ply laminate is adhered to a package or other surface by means of the adhesive 40. Before the bottom ply 20 is so adhered and if desired before the release liner 22 is removed, the two-ply tab comprising bonded tab portion 28 and section 52 is separated from both the top and bottom plies 18 and 20, released from the liner 22 and applied to another or the same surface by means of the adhesive 40 thereunder. Because they are not adhered directly to the release liner 22, the tab portion 26 and the label portion 29 may each be separated from the top ply 18 after the release liner 22 has been removed and the bottom ply 20 has been adhered to a surface. At an appropriate processing stage, the card portion 34 is removed by tearing it away from the top ply 18 along the perforation line 36. A cut-out portion 58 can be provided at one corner, as illustrated, or elsewhere along the perforation line 36 to facilitate removal of the card portion 34.

At an appropriate processing stage, the tab portion 26 and the label portion 29 are each separated from the top ply 18, released from the bottom ply 20 and adhered to a document or other desired surface by means of the adhesive 24 thereunder. The tab and label release portions 44 and 46 of release material coated onto the upper side of the bottom ply 20 permit easy release of the adhesive 24 on the underside of the tab and label portions 26 and 29. A cut-out similar to the cut-out portion 58, a tab or other arrangement known in the art can be associated with the tab and label portions 26 and 29 to facilitate removal, if desired. The upper side of the bottom ply 20 may be preprinted with the name of the shipper, a company logo or other promotional-type information which is exposed when the tab and label portions 26 and 29, and even when the card portion 34, are removed for use.

It will be apparent to one of ordinary skill in the art that one or more additional plies may be incorporated between the bottom ply 20 and the release liner ply 22 of label form 10. In such a case, adhesive 40 could be a releasable adhesive as taught by Doll et al in U.S. Pat. No. 5,039,652. An additional ply would thus be releasably attached to the under surface of bottom ply 20 of label form 10, and would in turn be coated with adhesive 40 on its underside. Of course, if adhesive 40 is the water activatable type, release liner 22 is eliminated.

The two-ply embodiment 12 of the present invention as shown in FIG. 3 is even less expensive than the label form 10 of FIGS. 1 and 2. As can be seen from that figure, the label form 12 includes components that are substantially identical to corresponding components of the label form 10. However, in the two-ply embodiment 12, the adhesive 40, liner ply 22 and two-ply tab (tab portion 28 and section 52) are eliminated. The label form 12 is a two-ply laminate comprising a top ply 60 and a bottom ply 62. The top ply 60 is virtually identical to the top ply 18 of form 10 except for the lack of tab portion 28. The underside of top ply 60 is coated with an adhesive 64 in a pattern identical to that described above for adhesive coating 24. Top ply 60 includes an adhesive backed tab portion 66 and label portion 68 which are respectively defined by generally rectangular die cuts 70 and 72, enabling them to be readily separable from the remainder of top ply 60. Top ply 60 also includes a card portion 74 defined by a line of perforations 76 such that card portion 74 is readily separable from the top ply 60.

A release material 77 coats the upper side of the bottom ply 62 including a tab release section 78 and a label release section 80 but not card section 82. The tab and label release sections 78 and 80 are defined by respective die cuts 84 and 86. Die cuts 84 and 86 preferably circumscribe the corresponding die cuts 70 and 72, respectively, making the tab and label release sections 78 and 80 slightly larger than the tab and label portions 66 and 68. The upper side of the card section 82 of bottom ply 62 is bounded by the release material 77 in a pattern corresponding to the pattern of adhesive 64 encircling card portion 74. Accordingly, the card section 82 is slightly larger than the card portion 74, with the border 88 circumscribing the perforated line 76. Alternatively, the border 88 can be in register with perforated line 76 or a perforated line (not shown) can be substituted for border 88. The tab, label and card sections 78, 80 and 82 are respectively located in register with the underside of the tab, label and card portions 66, 68 and 74 of top ply 60.

This two-ply embodiment may be preferred if promotional information to be exposed by removal of the card portion 74 is not desired or if the label form 12 could be sufficiently accurately placed on a package such that the card portion 74 covered similar information already printed on the package.

The two-ply embodiment of FIG. 3 may be used in the same way as the three-ply embodiment of FIGS. 1 and 2. The bottom ply 62 including the release material is peeled away from the remainder of the label form 12, leaving the tab and label release sections 78 and 80 respectively adhering to the tab and label portions 66 and 68 via adhesive 64. The remaining top ply 60 is adhered to a package or other surface by means of the adhesive 64. The card portion 74, tab portion 66 and label portion 68 are again removed at appropriate stages in the same manner as described above for the tab, label and card portions 26, 29 and 34 of label form 10. The tab and label release sections 78 and 80 facilitate release of tab and label portions 66 and 68 since they remain positioned between the adhesive 64 and the package surface. When the card portion 74 is removed, a portion of the package surface is exposed, rather than a portion of the bottom ply 20 as in the three-ply embodiment of FIGS. 1 and 2. Here again, if the label form 12 is properly positioned over a preprinted panel on the package, promotional material can be exposed by removal of the card portion 74. It is also contemplated to create a two-ply card portion by extending the adhesive 64 onto the underside of card portion 74 and forming a line of perforations or die cut (not shown) in the bottom ply 62 that is in register with the perforations 76.

The most common use of the above described two label forms of the present invention involves affixing the entire label form to another surface such as a package after peeling away the bottom most ply. However, it should be apparent that these label forms of the present invention can also be used in other applications wherein the bottom ply is never peeled away and the remainder of the label form is not adhered to another surface.

In FIG. 4, the two-ply label form 14 is shown which is particularly suited for facilitating certified or registered mail shipping operations. The label form 14 comprises a top ply 90 and a bottom ply 92. The underside of the top ply 90 is substantially completely covered with a coating of, preferably, pressure sensitive adhesive 94. Top ply 90 includes a card portion 96, two tab portions 97 and 98 and two label portions 132 and 134. Each of the label portions 132 and 134 are respectively defined by die cuts 136 and 138 to be readily separable from the remainder of top ply 90. The tab portions 97 and 98 are disposed one on either side of the card portion 96. The tab portions 97 and 98 are defined by lines of perforations 140 and 142, respectively, and part of a line of perforations 144 dividing the card and tab portions 96–98 from the remainder of the top ply 90. Lines of perforations 140 and 142 respectively divide tab portions 97 and 98 from the card portion 96. As an alternative, the adhesive 94 may be applied to selectively coat the underside of only the tab, label and card portions 97, 98, 132, 134 and 96 of top ply 90.

The bottom ply 92 is pattern coated with a release material, or otherwise made readily releasable from adhesive 94, on the upper side of two tab release sections 146 and 148 and two label release sections 150 and 152 which are located in register with the tab portions 97 and 98 and the label portions 132 and 134, respectively. Bottom ply 92 also has a card section 154 located in register with the card portion 96 which is free of any release material. Card portion 96 is thereby able to be permanently bonded adhesively to the card section 154 to form a two-ply card. The tab sections 146 and 148 are defined by die cuts 156 and 158, respectively, and part of a line of perforations 160 dividing the tab sections 146 and 148 and card section 154 from the balance of the bottom ply 92. Line 160 of bottom ply 92 is located in register with the line of perforations 144 of top ply 90. The label release sections 150 and 152 are respectively defined by borders 162 and 164, which can be die cut, and preferably formed slightly larger than the label portions 132 and 134, with the borders 162 and 164 respectively circumscribing the die cuts 136 and 138 of label portions 132 and 134.

For use in registered or certified mailing operations, appropriate address and other information is printed on the upper side of card portion 96 and on the underside of card section 154. The two-ply card 155, formed by card portion 96 and section 154, along with the two tab portions 97 and 98 and the tab release sections 146 and 148, are all readily separable together in one piece from the balance of the label form 14 by tearing along the registered lines of perforations 144 and 160. As should be apparent, the two tab release sections 146 and 148 are then peeled off and the two-ply card 155 is adhered to a package or other surface to be mailed by means of the adhesive 94 on the underside of the two tab portions 97 and 98. The two label portions 132 and 134 are also peeled away from the balance of label form 14 and adhered to the package, or any other surface desired, by means of the adhesive 94 on their underside. A cutout portion similar to the cut-out portion 58 shown in FIG. 1 or other arrangement known in the art can be operatively associated with each of the label portions 132 and 134 to facilitate their removal, if desired. Upon delivery of the package, the two-ply card 155 may be removed by tearing along the lines of perforations 140 and 142, signed by the recipient and mailed back to the sender.

Figure 5:
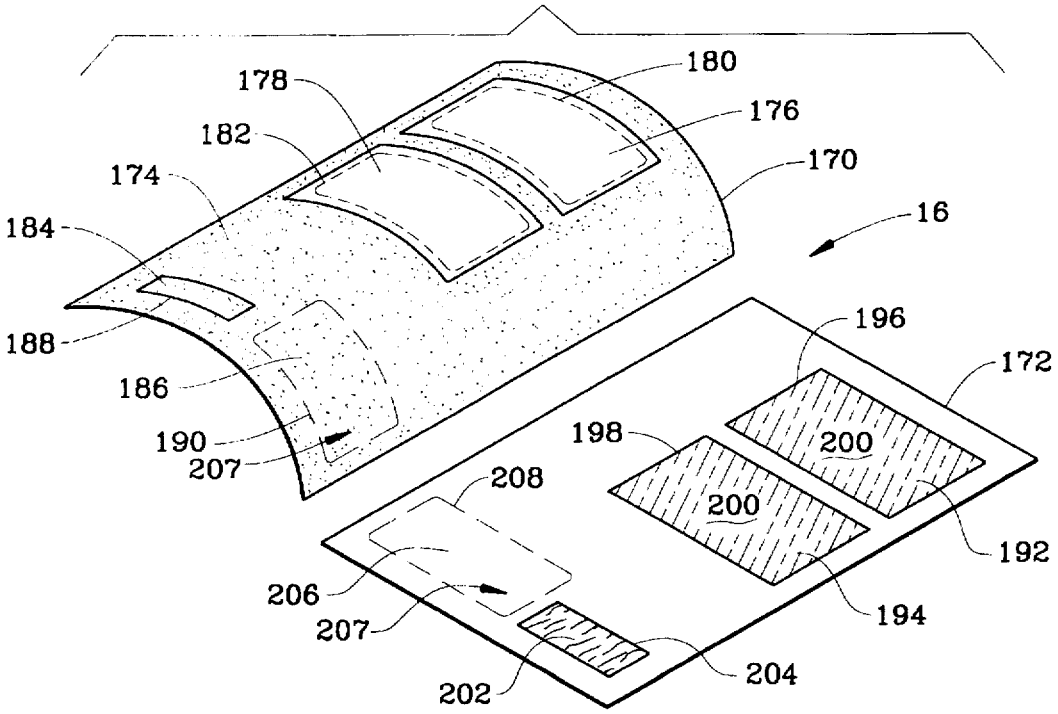
FIG. 5 is an exploded isometric view of still another embodiment of the present multiple-ply label form.

Referring to FIG. 5, the two-ply form 16, constructed in accordance with a further embodiment of the present invention, includes a top ply 170 and a bottom ply 172. While the present label form 16 can be utilized in a number of different business operations, it is capable of being used as a prescription form for facilitating the prescribing of medications and other medical treatments and will be so described hereafter. The underside of the top ply 170 is substantially coated with an adhesive 174 except under two card portions 176 and 178. Each of the single-ply card portions 176 and 178 is respectfully defined by a line of perforations 180 and 182 which enable each card portion to be readily separable from the top ply 170. Preferably, the adhesive free areas on the underside of top ply 170 are slightly larger than the card portions 176 and 178 such that each line of perforations 180 and 182 lies entirely inside the inner periphery of the adhesive 174. In this way, when each single-ply card portion 176 and 178 is separated from the top ply 170, it is assured of being completely free of adhesive. Accordingly, the upper side of each single-ply card portion 176 and 178 has information thereon which is used to denote and fill a doctor's prescription. In order to prevent the unauthorized photocopying of the prescription, the upper side of the card portions 176 and 178 preferably includes a preprinted "VOID" or other warning or cancellation phrase which is normally camouflaged but is visible on a photocopy of the portions 176 and 178. Such a document protection system can be found in U.S. Pat. Nos. 4,227,720; 4,310,180; 5,149,140; 5,197,765 and 5,340,159, all of which are incorporated in their entirety herein by reference. The top ply 170 also includes an adhesive backed label portion 184 and an adhesive backed pop-out card portion 186. The label portion 184 is defined by die cut 188, and the pop-out card portion 186 is defined by a line of perforations 190.

The bottom ply 172 has two card sections 192 and 194 corresponding to and respectively located in register with the underside of the two card portions 176 and 178. Each card section 192 and 194 is respectively defined by a border 196 and 198. The interface between the underside of card portions 176 and 178 and the upper side of card sections 192 and 194 may be provided with an imaging system, such as that described above. When an impact or pressure image is applied to the upper side of either card portion 176 and 178, a duplicate image is produced on the upper side of the corresponding card section 192 and 194. For example, the upper side of each card section 192 and 194 may be coated with a chemical self-contained material 200. See the discussion above regarding form 10 for further details on alternative imaging systems. The alternative imaging systems described above for form 10 are equally applicable to form 16 as well as the other forms 12 and 14 described in detail herein.

Bottom ply 172 also has a label release section 202 which is defined by border 204, and a pop-out card section 206 which is defined by a line of perforations 208. The label release section 202 and the pop-out card section 206 are respectively located in register with the underside of the label portion 184 and the pop-out card portion 186. Pop-out card section 206 is free of any release material and suitable for permanently bonding to the adhesive 174 on the underside of the pop-out card portion 186 to thereby form a two-ply pop-out card 207 readily separable from the label form 16. The two-ply popout card 207 may be used to provide medical information for or about a patient such as, for example, a card signed by a doctor providing an excuse for missing school or work. The pop-out card portion 186 and card section 206 are preferably the same size, thereby enabling both the lines of perforations 190 and 208 to be formed by a single cut extending through both plies 170 and 172. Each card portion 176 and 178 and the label portion 184 may include a cut-out portion similar to the cut-out portion 58 shown in FIG. 1 or some other arrangement known in the art to facilitate their separation from top ply 170.

The label portion 184 of top ply 170 may have a patient's prescription information or other medical information printed thereon. The label portion 184 would then be peeled off and applied to the patient's medical file or other appropriate surface. When an impact or pressure image is produced on the upper side of label portion 184, a duplicate image can be produced on the upper side of label section 202 by disposing an imaging means therebetween. For example, the bottom ply 172 can be a sheet fully coated with a chemical self-contained material. It is preferred, however, that any imaging coating be applied locally only to the areas where a duplicate image is needed. The single form construction of the present label form 16 enables each portion 176, 178, 184 and 186 of the label form 16 to be printed with the patient's medical information all at once, saving support staff time in preparing each portion and the doctor's time in executing the applicable portions. The two-ply pop-out card formed by the lamination of card portion 186 and section 206 is also of uniform overall caliper and therefore compatible with laser printers.

A number of variations will be apparent to one skilled in the art from the foregoing description. For example, the plies of the label forms may be made from paper or other fibrous sheets or non-fibrous polymer or any other convenient material, and may range in weight from about 20 lbs. up to about 150 lbs. or more per ream of material (17"×22"×500"). Adhesives may be pressure sensitive, remoistenable or heat activated and may be chosen from any convenient type including water based, solvent based, hot melt, or 100% solids. Further, label forms of the present invention may be manufactured as separate individual label forms or they may be adhered to one another in a continuous web divided by perforations. If individually manufactured, the label forms may be carried on a continuous web for ease of handling in a given application.

From the above disclosure of the general principles of the present invention and the preceding detailed description, those skilled in this art will readily comprehend the various modifications to which the present invention is susceptible. Therefore, the scope of the invention should be limited only by the following claims and equivalents thereof.

What is claimed is:

1. A multiple-ply label form for an operation control system comprising:

a first ply having an underside and including at least one first portion and at least one second portion, the underside of said at least one second portion being substantially coated with an adhesive, said first portion and said second portion being readily separable from a remainder of said first ply and being adapted for having indicia applied thereon; and a second ply having an upper side adhesively bonded to the underside of said first ply, at least one first section and at least one second section respectively in register with said at least one first portion and said at least one second portion, said at least one second portion being adhesively bonded to and readily releasable from the upper side of said at least one second section and securable elsewhere by means of the adhesive thereon, said at least one first section being readily separable from said second ply, and the underside of said at least one first portion being permanently bonded with the upper side of said at least one first section by an adhesive to form a multiple-ply laminate readily separable from said form, wherein the upper side of said at least one second section is coated with release material and wherein said first ply has one first portion and two second portions, said second ply has one first section and two second sections respectively in register with said one first portion and said two second portions, one second portion is disposed on either side of and readily separable from said one first portion, said one first portion is permanently bonded to said one first section to form a multiple-ply card, and said two second portions and said multiple-ply card are readily separable together in one piece from the balance of said form.

2. The form of claim 1, wherein said first ply includes two additional second portions and said second ply includes two additional second sections, each of said two additional second sections is in register with one of said two additional second portions.

3. The form of claim 2, wherein said first ply is a top ply having an underside substantially coated with an adhesive, said first portion is a card portion, each of said second portions is a tab portion, and each of said additional second portions is a label portion, one tab portion is disposed on either side of and readily separable from said card portion, and each said portion is readily separable from a remainder of said top ply and is adapted for having indicia applied thereon, and said second ply is a bottom ply having an upper side adhesively bonded to the underside of said top ply, said first section is a card section, each of said second sections is a tab section, and each of said additional second sections is a label section, the upper side of said two tab sections and said two label sections is substantially coated with a release material, said card section is readily separable from a remainder of said bottom ply, said card portion is permanently bonded adhesively to said card section to form a multiple-ply card, and said two tab portions and said multiple-ply card are readily separable together in one piece from the balance of said form.

* * * * *